US008641311B2

(12) United States Patent
Vetter et al.

(10) Patent No.: US 8,641,311 B2
(45) Date of Patent: Feb. 4, 2014

(54) CLEANING HEAD FOR A TARGET SURFACE

(75) Inventors: Kerry Andrew Vetter, Cincinnati, OH (US); Hirotaka Uchiyama, Loveland, OH (US); Glenn Allen Bradbury, Mason, OH (US); Adam Robert-George Shafer, Cincinnati, OH (US); Joseph Michael Gaines, Cincinnati, OH (US); Francisco Go Lao, Jr., Mason, OH (US); Gregory Clegg Spooner, Hong Kong (CN)

(73) Assignee: The Procter & Gamble Company, Cincinnati, OH (US)

( * ) Notice: Subject to any disclaimer, the term of this patent is extended or adjusted under 35 U.S.C. 154(b) by 335 days.

(21) Appl. No.: 12/901,804

(22) Filed: Oct. 11, 2010

(65) Prior Publication Data

US 2012/0084933 A1 Apr. 12, 2012

(51) Int. Cl.
*B05C 21/00* (2006.01)
*B43K 5/00* (2006.01)

(52) U.S. Cl.
USPC ..... 401/196; 15/104.93; 15/104.94

(58) Field of Classification Search
USPC ..... 401/196; 15/104.93, 104.94, 227; 510/191, 193, 296, 439
See application file for complete search history.

(56) References Cited

U.S. PATENT DOCUMENTS

| | | | | |
|---|---|---|---|---|
| 4,522,738 | A * | 6/1985 | Magid et al. | 510/100 |
| 4,863,655 | A | 9/1989 | Lacourse et al. | |
| 5,378,832 | A | 1/1995 | Kurane et al. | |
| 5,440,775 | A | 8/1995 | Banks | |
| 5,471,697 | A | 12/1995 | Daconta | |
| 5,706,553 | A | 1/1998 | Riley et al. | |
| 5,878,459 | A | 3/1999 | McParland | |
| 5,888,002 | A | 3/1999 | Fenstersheib | |
| 6,146,494 | A | 11/2000 | Seger et al. | |
| 6,183,150 | B1 | 2/2001 | Kao | |
| 6,231,970 | B1 | 5/2001 | Andersen et al. | |
| 6,649,188 | B2 | 11/2003 | Gilleland et al. | |
| 6,709,526 | B1 | 3/2004 | Bailey et al. | |
| 6,832,405 | B1 | 12/2004 | Miller | |
| 6,880,197 | B2 | 4/2005 | Katz et al. | |
| 6,966,720 | B2 | 11/2005 | Moss | |
| D513,444 | S | 1/2006 | Vitantonio et al. | |
| 7,032,270 | B2 | 4/2006 | Vitantonio et al. | |
| 7,059,008 | B2 | 6/2006 | Morgan et al. | |
| 7,065,823 | B2 | 6/2006 | Llanes | |
| 7,065,825 | B2 | 6/2006 | Minkler et al. | |

(Continued)

FOREIGN PATENT DOCUMENTS

| | | | |
|---|---|---|---|
| GB | 2 158 701 | A | 11/1985 |
| GB | 2 362 565 | A | 11/2001 |

(Continued)

OTHER PUBLICATIONS

Search Report 5 Pages.

*Primary Examiner* — David J. Walczak
*Assistant Examiner* — Jennifer C Chiang
(74) *Attorney, Agent, or Firm* — Larry L. Huston; Steven W. Miller

(57) ABSTRACT

A unit dose for cleaning an unsanitary surface, such as a toilet bowl. The unit dose comprises a water dispersible shell containing granules defining a core. The granules obviate the need for sheet material in the unit dose and provide cleaning efficacy when submerged.

15 Claims, 2 Drawing Sheets

(56) References Cited

U.S. PATENT DOCUMENTS

| | | | | |
|---|---|---|---|---|
| 7,131,783 | B1 | 11/2006 | DeRoma | |
| 7,159,265 | B2 | 1/2007 | Soller et al. | |
| 7,169,740 | B2 * | 1/2007 | Sommerville-Roberts et al. | 510/296 |
| 7,275,276 | B2 | 10/2007 | Jaszenovics et al. | |
| D556,406 | S | 11/2007 | Murphy | |
| 7,316,046 | B2 | 1/2008 | Michaels et al. | |
| 7,375,070 | B2 * | 5/2008 | Pegelow et al. | 510/296 |
| D572,872 | S | 7/2008 | Bergh | |
| 7,467,437 | B2 | 12/2008 | Hagleitner et al. | |
| D588,365 | S | 3/2009 | Conway et al. | |
| 7,530,138 | B1 | 5/2009 | Platt | |
| 7,581,276 | B2 | 9/2009 | Endo et al. | |
| 7,595,290 | B2 * | 9/2009 | Pounds et al. | 510/295 |
| 7,603,739 | B2 | 10/2009 | Minkler et al. | |
| 7,650,663 | B2 | 1/2010 | Michaels et al. | |
| 7,666,261 | B2 | 2/2010 | Bailey et al. | |
| D614,373 | S | 4/2010 | Zach et al. | |
| D614,376 | S | 4/2010 | Bachmeier | |
| 7,704,328 | B2 | 4/2010 | Bailey et al. | |
| 7,742,451 | B2 | 6/2010 | Haumont et al. | |
| 7,743,451 | B2 | 6/2010 | Kim | |
| 7,761,950 | B2 | 7/2010 | Konishi et al. | |
| D622,017 | S | 8/2010 | Murphy | |
| 7,788,758 | B2 | 9/2010 | Konishi et al. | |
| 7,938,908 | B2 | 5/2011 | Bailey et al. | |
| 7,939,010 | B2 | 5/2011 | James et al. | |
| 7,951,440 | B2 * | 5/2011 | Butler, III | 428/36.9 |
| 2001/0014388 | A1 | 8/2001 | Bastioli et al. | |
| 2002/0054784 | A1 | 5/2002 | Wolf | |
| 2004/0048759 | A1 | 3/2004 | Ribble et al. | |
| 2005/0074275 | A1 | 4/2005 | Hart et al. | |
| 2005/0155627 | A1 | 7/2005 | Bober et al. | |
| 2005/0266230 | A1 | 12/2005 | Hill et al. | |
| 2006/0225237 | A1 | 10/2006 | Gartland | |
| 2007/0081850 | A1 | 4/2007 | DeRoma | |
| 2007/0220690 | A1 | 9/2007 | Dwiggins et al. | |
| 2008/0003906 | A1 | 1/2008 | Hill et al. | |
| 2008/0250590 | A1 | 10/2008 | Trefethren et al. | |
| 2008/0262797 | A1 | 10/2008 | Carusi et al. | |
| 2008/0263797 | A1 | 10/2008 | Berger et al. | |
| 2009/0170971 | A1 | 7/2009 | Lee et al. | |
| 2009/0312215 | A1 | 12/2009 | Glenn et al. | |
| 2010/0306937 | A1 | 12/2010 | Konishi et al. | |
| 2011/0281324 | A1 | 11/2011 | Adams et al. | |
| 2012/0246850 | A1 | 10/2012 | Gaines et al. | |
| 2012/0246853 | A1 | 10/2012 | Uchiyama et al. | |
| 2012/0246854 | A1 | 10/2012 | Uchiyama et al. | |

FOREIGN PATENT DOCUMENTS

| | | | |
|---|---|---|---|
| WO | WO 2005/034704 | A1 | 4/2005 |
| WO | WO 2009/080130 | | 7/2009 |
| WO | WO 2009/080130 | A1 | 7/2009 |

* cited by examiner

CLEANING HEAD FOR A TARGET SURFACE

FIELD OF THE INVENTION

The present invention is directed to cleaning devices and more particularly to cleaning devices suitable for having an optional handle for gripping by a user and a cleaning head removably attachable to the handle.

BACKGROUND OF THE INVENTION

Devices for cleaning dirty and unsanitary areas are well known in the art. Typically the devices have a cleaning head for contacting and cleaning the surface of the unsanitary area. The head may be attached to an elongate handle, so that the user's hand is remote from, and does not contact, the dirty and unsanitary surface during cleaning.

One example of such a device is a toilet brush. The toilet brush may have bristles at one end which are immersed in the toilet bowl, often times with cleanser. The cleanser may be separately dispensed into the toilet bowl. Dual brush heads may be employed, as taught by U.S. Pat. No. 5,440,775. A two-sided scrub brush having bristles and a sponge head may be employed, as taught by U.S. Pat. No. 6,832,405.

The brush head may be permanently attached to an elongate handle for gripping by the user. The handle is intended to prevent the user's hand from being wetted by the water in the toilet bowl.

One attempt to provide convenience to the cleaning task is to have a toilet bowl brush with an integrated refillable reservoir. The cleaning fluid is disposed in dispensed from the reservoir, as shown in U.S. Pat. No. 7,131,783. Another attempt is U.S. Pat. No. 6,880,197 having a brush head which may include a toilet cleaning chemical embedded therein. However, these attempts do not overcome the problems encountered after the cleaning task is finished.

After cleaning, the toilet brush is then typically stored until the next use. However, the toilet brush may be wet, and unsanitary even if rinsed. The toilet brush may have an unpleasant smell and/or breed germs.

An attempt to overcome this problem has been to develop a head which is detachable from the handle. The head may be discarded after a single use, obviating the need to store that head under unpleasant and/or unsanitary conditions. One such attempt in the art is found in U.S. Pat. No. 5,888,002 which teaches a head having a brush molded from a one-piece flexible plastic material. The brush may be supplied with detergent or disinfectant. After use, the brush is disposed in a bag and discarded. However this attempt simply moves the unsanitary head from storage to a disposable bag. The user must handle the dirty head after each use to place it in the bag and then discard that bag.

An attempt to overcome this problem has been to use flushable brush heads. The flushable brush heads are typically made of sheets of water dissolvable material, as taught by U.S. Pat. Nos. 7,059,008; 7,159,265; 7,316,046; 7,581,276; and 7,650,663. Commercial embodiments of cleaning brushes having a head with sheet material have not been well accepted, apparently because the sheet material, does not provide enough cleaning power to be efficacious.

WO 2009/080130 acknowledges this drawback in a cleaning device having paper material, and even paper material impregnated with detergent. But the '130 attempt at a solution is to provide a cleaning element having biodegradable plastic material, for example 70-80 percent polyvinyl alcohol and the remainder poly plasticizers. But these materials are known to slowly dissolve, leading to difficulty with flushing. Even if the device appears too large to be safely flushed after use, the user may separately discard the head—leading back to the unsanitary conditions sought to be avoided.

Attempts to improve upon the heads comprising sheet material is found in U.S. Pat. No. 7,530,138 which teaches a brush heads having loops made of paper. Again, it is unlikely the paper will provide sufficient cleaning power to be efficacious. Another attempt is found in U.S. Pat. No. 7,761,950 which teaches water disintegrable cords. However, these cords are simply found by twisting a water-disintegrable sheet, such as a nonwoven.

One attempt to overcome these problems is found in US 2005/0074275 which teaches a cleaning device having a single dose of non-aqueous or anhydrous powder made of a water soluble foil, such as PVA. The cartridge of that invention is constructed is as a sachet having a tube sealed at the ends resulting in no flange around the edge of the sachet.

An attempt to improve upon the water soluble foil is found in US 2008/0263797 which teaches a brush head having a dissolvable wrapper. This attempt further teaches the use of sheet materials having about 90 to 100% cellulosic pulp fibers—and takes us back to the earlier attempts using sheet materials and the associated problem upon saturation of insufficient stiffness to provide effective cleaning. Yet another attempt to use a cleaning head formed from a cellulose-containing substances such as paper is found in U.S. Pat. No. 7,743,451.

All of the aforementioned brush heads must be attached to a handle for the convenience and sanitation of the user. Illustrative handles are taught in U.S. Pat. Nos. 5,706,553; 5,878,459; 6,966,720; 7,065,825; 7,603,739; 7,743,451; 2007/0081850; 2008/0250590; D513,444; D588,365; D614,373; and/or D622,017.

However none of the aforementioned attempts in the art overcome the dueling problems of providing flushability with sufficient cleaning power to be efficacious. Accordingly, there is still a need in the art for an improved cleaning device, usable for cleaning unsanitary areas such as a toilet.

SUMMARY OF THE INVENTION

The invention comprises a unit dose for cleaning a target surface and being attachable to a handle. The unit dose comprises a water dispersible shell, and a core encased by the shell. The core comprises at least one granular material, is free of sheet material and is optionally free of cellulose or nonwoven material.

DETAILED DESCRIPTION OF THE INVENTION

Figure 1A:
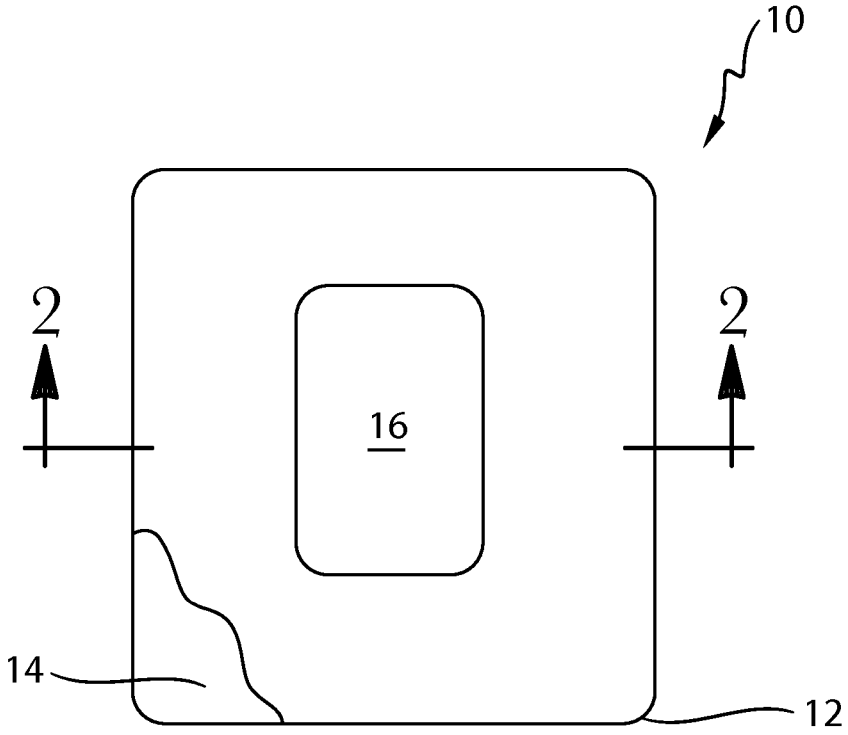
FIGS. 1A and 1B are a top plan view, shown partially in cutaway, and a bottom plan view, respectively, of a unit dose according to the present invention having no flange.
Figure 1B:
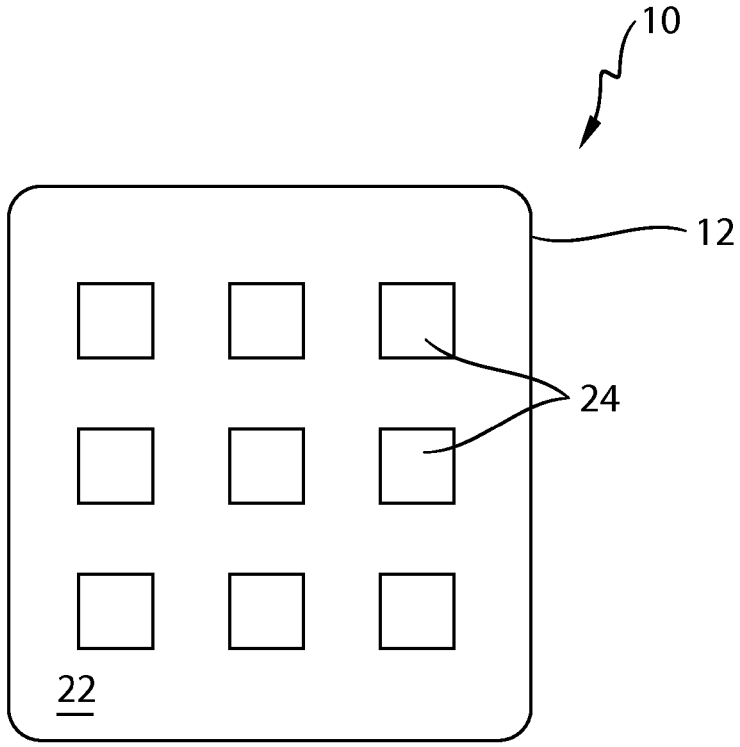

Referring to FIGS. 1A and 1B, the invention comprises an article suitable for cleaning a dirty, unsanitary surface. The article may be used while submerged, such as in a toilet bowl or may be used with water added from an external source. The article may be presented as a unit dose 10, i.e. suitable for use in a single cleaning task, then discarded. The unit dose 10 may be flushable, i.e. discardable after use by flushing down a common toilet.

The unit dose 10 may comprise a water dispersible shell 12. The shell 12 may encase a core 14, preventing unintended loss/escape of the contents of the core 14. The unit dose 10 version of this article may have a weight ranging from 15 to 100 grams, and 30 to 60 grams and may be generally shaped like an ellipsoid, sphere, paraboloid, satchel, pin cushion, short cylinder, parallelpiped or any other suitable shape. The unit dose 10 may have a major dimension ranging from 2 to 25 cm or 4 to 10 cm. The unit dose 10 shape may further comprise appendages, protrusions, etc.

One suitable protrusion may be a grip 16, as shown. The grip 16 may extend outwardly from a major surface of the unit dose 10. The grip 16 is suitable for being removably and releasably gripped by an optional handle, and particularly maybe removably and releasably gripped by the distal end of the handle. The user may hold the proximal end of the handle, for manipulation during the cleaning process. The optional handle may attach directly to the sides of the unit dose, obviating the need for a dedicated grip 16.

The grip 16 may be relatively solid, so that it is not unduly compressed or deformed when gripped by the handle. The grip 16 may comprise the same materials used in the balance of the core 14, provided such materials can be packed with sufficient density to provide a protrusion solid enough for secure gripping by the handle.

The grip 16 may or may not have a cleaning function, and may simply provide for convenient attachment to a handle. Accordingly, the grip 16 may contain sheet material, non-woven fibers or cellulose, as the presence of these materials in the grip 16 do not deleteriously affect cleaning performance. The grip 16 may comprise the water dispersible film material used to construct the shell 12.

Opposite the grip 16 may be another major face of the unit dose 10. This major face may be suitable for contacting the surface to be cleaned, for example the inside of the toilet bowl above and below the water line. By having the grip 16, and thus the handle, opposed to the major face used for scrubbing the target surface, ergonomics may be enhanced over other configurations.

By water dispersible it is meant that the material exhibits visible change when flushed in a typical residential toilet and passes through the waste system. In a degenerate case, the water dispersible shell 12 may be water-soluble. By water-soluble it is meant that the material is soluble or otherwise dispersible to a micellar solution in 25 degrees C. water at a level of at least 25 weight percent. The shell 12 may be usable in cool water, as commonly encountered in a toilet, e.g 10 degrees C. or so. The material selected for the shell 12 may further have sufficient strength to prevent unintended tearing and/or leakage of the contents of the core 14 material. The material selected for the shell 12 may further be relatively flexible, to allow for convenient manufacture.

A water dispersible film, such as polyvinyl alcohol film, hereinafter referred to as PVOH film, may be used for the shell 12. The film may disperse or even dissolve with mild agitation in cold water within 10 to 300, 30 to 180 or 45 to 90 seconds of being immersed in the water. The shell 12 is may be made of a film material which is soluble or dispersible in water, and has a water-solubility of at least 50%, 75% or 95%. The water-solubility is measured by using a glass-filter with a maximum pore size of 20 microns: 50 grams±0.1 gram of shell 12 material is added to a pre-weighed 400 ml beaker and 245 ml±1 ml of distilled water is added. This mixture is vigorously stirred at 600 rpm for 30 minutes using a magnetic stirrer. Then the mixture is filtered through a folded qualitative sintered-glass filter with a pore size of 20 microns. The water is dried from the collected filtrate by any conventional method, and the weight of the remaining shell 12 material is determined to be the dissolved or dispersed fraction. Then, the percentage solubility or dispersability can be easily calculated.

The shell 12 material can, for example, be obtained by casting, blow-molding, extrusion or blown extrusion of polymeric material, as known in the art. Polymers, copolymers or derivatives thereof suitable for use as shell 12 material may be selected from polyvinyl alcohols, polyoxethylene, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragumand may include polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and may further include polyvinyl alcohols, polyvinyl alcohol copolymers and hydroxypropyl methyl cellulose (HPMC), and combinations thereof. The level of polymer in the shell 12 material, such as a PVOH polymer, may be at least 60 weight percent. The polymer can have any weight average molecular weight, such as 1000 to 1,000,000; 10,000 to 300,000 or 20,000 to 150,000.

Polymer blend compositions comprising hydrolytically degradable and water-soluble polymer blends such as polylactide and polyvinyl alcohol, obtained by mixing polylactide and polyvinyl alcohol, typically comprising 1-35% by weight polylactide and 65% to 99% by weight polyvinyl alcohol may be selected for the shell 12 material. The polymers may be from 60% to 98% hydrolysed, and 80% to 90% hydrolysed, to improve the dissolution characteristics. The shell 12 material may have a thickness ranging from 0.002 to 2.5 millimeters, or 0.02 to 0.08 millimeters.

The shell 12 material may be gas permeable, to allow off-gassing of any gasses exuded from or generated by the core 14 material. Alternatively or additionally, one or more pinholes or vents may be included in the shell 12 material to accommodate offgassing.

The shell 12 material may also comprise one or more additive ingredients such as plasticisers such as glycerol, ethylene glycol, diethyleneglycol, propylene glycol, sorbitol and mixtures thereof. Other additives may include functional detergent additives such as organic polymeric dispersants.

Different film material and/or films of different thickness may be employed in making the compartments 32 of the present invention. One benefit of selecting different films is that the resulting portions of the shell 12 may exhibit different solubility or release characteristics.

If a PVOH film is selected, it may have a water content ranging from 8 to 12 weight percent, a thickness of 76 microns and a tensile strength sufficient to resist shear forces encountered in use. PVOH film sold under the trade name Monosol M8630, as sold by MonoSol LLC of Merrillville, Ind., US, and PVOH films of corresponding solubility and deformability characteristics may be suitable for the shell 12 material. Films known under the trade name PT film or the K-series of films supplied by Aicello, or VF-HP film supplied by Kuraray may also be suitable for the shell 12 material.

The core 14 of unit dose 10 may be free from sheet material, such as a nonwoven, tissue grade cellulose etc. Further, the core 14 of the unit dose 10 may be free of nonwoven materials, and/or cellulose materials whether presented in sheet form, as a cord, etc. Further, the core 14 of the unit dose 10 may be free of nonwoven fibers and/or cellulose fibers, even if dispersed throughout, or even within the core 14 as individual fibers. If desired, the core 14 may contain plural nonwoven and/or cellulose fibers, not in sheet form, and individually separated from other fibers. The fibers may have a length of up 5, 10 or 15 millimeters.

The core 14 of the unit dose 10 may comprise granular materials. The granular materials may comprise a homogeneous or heterogeneous distribution of one or more granular materials. By granular, it is meant that the materials have an individual particle size less than 5 mm in any direction. The granular materials may have a particle size distribution ranging from 1 to 5000 microns or 300 to 1000 microns as measured by a laser micrometer. The granular materials may be compressed to form a tablet configuration. Alternatively or additionally, the granular materials may absorb ambient moisture, causing solidification into a defined and solid shape and form.

For the invention claimed herein the granular materials may be alternatively or additionally be free-flowing and farinaceous, and may include individual fibers of cellulose or nonwoven. The granular materials may be water soluble, water dispersible, or simply small enough to be flushable.

The granular materials may comprise one or more of a surfactant, detergent, carboxylic acid, foaming agents, oxidants, enzymes, anti-soiling polymers, inorganic/organic abrasives, perfume, etc. and combinations thereof. The oxidants may be used for bleaching, disinfection, and breaking down organic materials. Chlorine oxygen bleaches, and/or reducing agents may be selected. Likewise, enzymes may be used to digest organic materials. PH modifiers may also be included, such as acids for de-scaling the toilet bowl and/or caustics to further break down organic material. Polymeric ingredients are known for incorporation into cleaning compositions and may be incorporated into the core 14 of the unit dose 10. Detergent compositions comprising cleaning polymer are taught in commonly assigned WO 06/130442 and WO 06/130575.

One homogenous distribution of a single granular material may comprise a surfactant, organic acid or combination thereof. The surfactants can be anionic, nonionic, zwitterionic, ampholytic or cationic and mixtures thereof, but does not include fatty acids or soaps thereof.

Nonionic surfactants may be of the formula $R^1(OC_2H_4)_nOH$, wherein $R^1$ is a $C_{10}$-$C_{16}$ alkyl group or a $C_8$-$C_{12}$ alkyl phenyl group, and n is from 3 to 80, and may further condensation products of $C_{12}$-$C_{15}$ alcohols with from 5 to 20 moles of ethylene oxide per mole of alcohol, e.g., $C_{12}$-$C_{13}$ alcohol condensed with 6.5 moles of ethylene oxide per mole of alcohol. The mean weight average molecular weight $M_w$ of the surfactants in present invention may be from 200 to 850, and from 250 to 700. The surfactant may comprise water soluble alpha olefin sulfonate. If a surfactant granular material is selected, a suitable surfactant granular material is available from the Stepan Co. of Northfiel, Ill. under product name Bio-Terge AS-90 beads.

If a carboxylic acid granular material, and particularly an organic acid granular material is selected, a suitable organic acid may have a pH ranging from 1 to 6.9 or 3 to 5. The organic acid may be selected from the group consisting of lactic acids, acetic acids, formic acids, citric acids, oxalic acids, tartaric acid, glycolic acid, ascorbic acid, phthalic acid, maleic acid, trichlorocyanuric acid, uric acids and combinations thereof. An organic acid having a relatively low molecular weight, e.g. formic acid or lactic acid, may be selected for miscibility in water. Alternatively or additionally a crystalline citric acid of $C_6H_8O_7$ and derived from carbohydrate fermentation, lemon, lime, pineapple juice and combinations thereof may be used. If an organic acid granular material is selected, a suitable organic acid granular material is available from EMD Chemicals Inc. of Gibbstown, N.J.

If desired, the unit dose 10 may further comprise particulate materials. By particulate, it is meant that the materials do not disperse or dissolve in water, in contrast to the granules which do. Particulates may include, without limitation, for example, diatomaceous earth, coconut shell fibers, walnut shells, crushed sea shells, calcium carbonate, sodium dodecyl benzene sulfonate, zeolites and/or other abrasives and combinations thereof. The particulates provide the benefit of an aggressive material suitable for scrubbing above or below the waterline. The particulates may be of small size, to maintain flushability. The particulates may have a diameter less than 100, 75 or 50 microns.

If desired, the core 14 of the unit dose 10 may further comprise effervescent. An effervescent will produce gas in the form of bubbles when submerged below the water line of the toilet. The gas production results in disturbance of the water, potentially helping to break up components of the unit dose 10 and improve flushability. The effervescent may comprise sodium bicarbonate, etc. Alternatively or additionally, a film which disperses/dissolves more slowly may be used for the portion of the shell 12 containing the second stratum **30*b* and/or grip 16 than for the balance of the unit dose 10. Alternatively or additionally, the grip 16 may comprise two, three, or more layers of film to retard this dispersion/dissolution of the grip 16 so that it can last throughout the intended cleaning task without detachment of the unit dose 10** from the handle.

Figure 2:
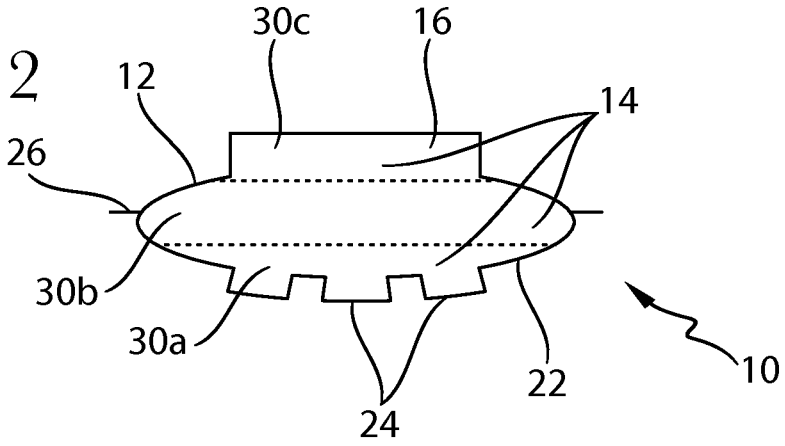
FIG. 2 is a sectional view taken along line 2-2 of FIG. 1A and showing the addition of an optional flange.

Referring to FIG. 2, the core 14 of the unit dose 10 may contain plural strata 30 of granular materials, or other materials which do not comprise sheets, nonwoven fibers or cellulose fibers. The plural strata 30 may comprise two strata 30, three strata 30, or more, as desired. The strata 30 may be coextensive with the boundary defined by the shell 12 or an individual stratum may be contained within and bounded by other strata 30. Of course, one of skill will recognize that the strata 30 may not have distinct and well defined boundaries. Some intermixing of materials from one stratum to the next may occur at the interface.

The unit dose 10 may have a first outwardly facing stratum juxtaposed with the shell 12, and particularly the outwardly facing surface 22 of the unit dose 10 used for scrubbing/cleaning. The unit dose 10 may comprise a second stratum **30*b* central to and sandwiched between the first stratum 30*a* and third stratum 30*c*. The third stratum 30*c* may be substantially disposed within the grip 16 or may comprise the grip 16 plus at least a portion of the surface from which the grip 16** extends.

If a tri-strata 30 configuration is selected, the first stratum **30*a* may comprise surfactant, acid, and/or a liquid such as bleach or liquid detergent. The second stratum 30*b* may comprise organic acid and an effervescent. The weight ratio of the organic acid/effervescent may range from 2.5:1 to 1:2.5 and may be about 1:1. The third stratum 30*c* may comprise effervescent. More particularly, the first stratum 30*a* may comprise surfactant and/or citric acid, the second stratum 30*b* may comprise citric acid and sodium bicarbonate, and the third stratum 30*c* may be substantially confined to the grip 16 and comprise sodium bicarbonate which can improve dissolution of the unit dose 10** by increasing the acidity of the toilet water.

The first stratum 30*a* may comprise from 5 to 50, or 20 to 30 weight percent of the granular materials in the core 14. The second stratum 30*b* may comprise from 10 to 90 or 40 to 70 weight percent of the granular materials in the core 14. The third stratum 30*c* may comprise from 5 to 50 or 20 to 30 weight percent of the granular materials in the core 14. If desired, the core 14 may also comprise a liquid material, provided that the liquid material does not cause premature degradation of the shell 12. The liquid material may comprise any of the aforementioned functionalities discussed above relative to granular materials.

Figure 3:
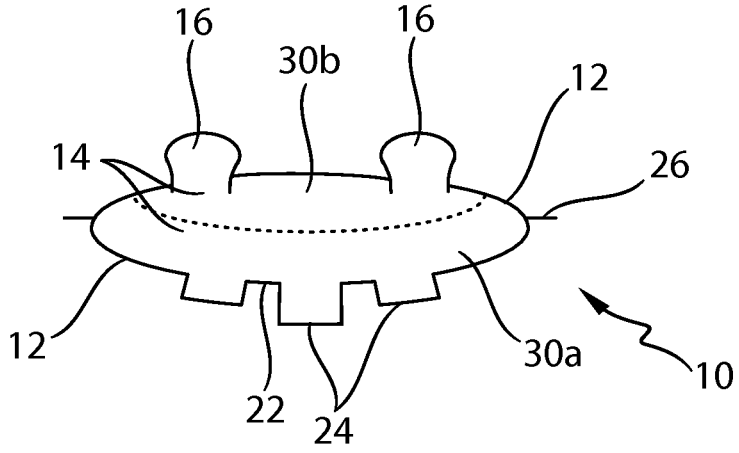
FIG. 3 is a sectional view of an alternative embodiment having a single compartment with two strata and a curvilinear interface therebetween, dual grips and differential height protuberances.

Referring to FIG. 3, if desired the core 14 of the unit dose 10 may comprise two strata 30. The first strata 30*um* juxtaposed with the outwardly facing surface 22 of the shell 12 may comprise granular materials having a surfactant and organic acid. The second stratum 30*b*, oppositely disposed from the first including the optional grip 16, may comprise an effervescent. The interface between the strata 30 may be convex, concave or any generally curvilinear shape. This arrangement allows flexibility in adjusting the percentage of ingredient in a particular strata 30, The granular materials of the first stratum 30*a* may create a microtexture of asperities. These asperities may locally increase pressure on the target surface in response to compression applied by the user through the handle. The local increase in pressure may assist in scrubbing stains etc. from the toilet bowl. The granular materials may be in the shape of rods, sheets, spheres and/or combinations thereof and have a particle size from 1 to 13,000 or 100 to 5000 microns.

Thus, if desired, the size/shape/hardness of the granular materials comprising the first stratum 30*a* may be managed with the properties of the shell 12 covering and juxtaposed with the outwardly facing surface 22 of the first stratum 30*a* to improve its scrubbing performance. For example, the film making up the shell 12 at the outwardly facing surface 22 of the first stratum 30*a* may be particularly compliant so that the texture and asperities of the granules are presented therethrough to the target surface.

Thus, the PVOH film overlying the outwardly oriented face of the first stratum 30*a* may be particularly thin so that it dissolves faster than other portions of the unit dose 10 and the granules are presented directly to the target surface. If desired, the shell 12 may contain small pores or slits to allow the entry of water therethrough. The entry of water allows direct contact of the water with the granular materials, increasing the rate of dispersion/dissolution.

Referring back to FIGS. 1A and 1B, the outwardly facing surface 22 of the unit dose 10 may further comprise a macrotexture. A macrotexture is a texture generally significantly larger than the texture presented by any one granule or the asparaties created thereby. The macrotexture may optionally comprise a plurality of outwardly extending protuberances 24, as shown. The protuberances 24 may extend outwardly from the surface a distance of 2 to 10 or 3 to 6 mm and comprise from 20 to 70 or 30 to 50 percent of the surface area of the outwardly facing surface 22. The protuberances 24 may be equal or unequal height, pitch and/or shape. For example, protuberances 24 extending further from the target surface may be juxtaposed with the center of the outwardly facing surface 22, to more evenly distribute forces against the target surface, as applied by the user.

The unit dose 10 may be assembled using techniques known to one of ordinary skill. For example, a first layer of shell 12 material may be disposed in a cavity and the core 14 material added thereto. A second layer of shell 12 material may overlay the core 14 material. The two layers of core 14 material may be peripherally sealed, using water soluble adhesive, heat sealing etc.

The two layers of shell 12 material may be peripherally trimmed to create a flange 26 circumscribing the unit dose 10. The flange 26 may extend 1 to 100 or 2 to 10 mm outwardly from the shell 12, and advantageously improve scrubbing against the target surface.

Figure 4:
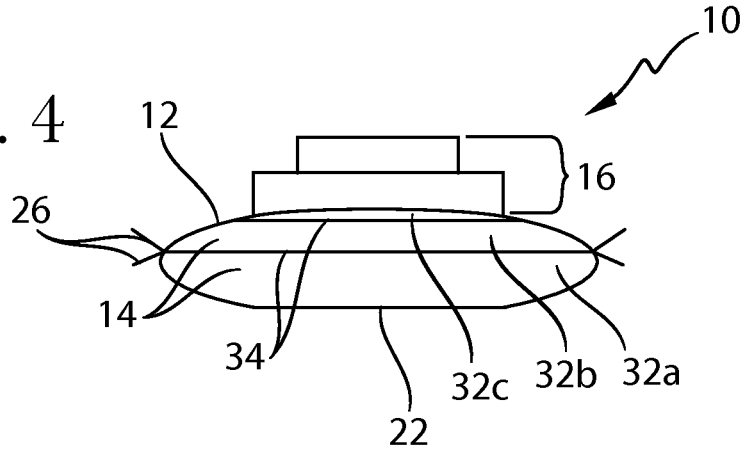
FIG. 4 is a sectional view of an alternative embodiment having plural compartments, dual flanges of differential lengths, an offset nonflushable grip and large asperities on the outwardly facing surface

The unit dose 10 may comprise a single compartment 32, as described above. Referring to FIG. 4, alternatively, the unit dose 10 may comprise plural compartments 32 separated by internal film material 34 usable for the shell 12. Each compartment 32 may contain separate chemistry or functionality material for that portion of the core 14. The compartments 32 may contain different core 14 materials not intended to mixed until the point of use. For example a first compartment 32*a* may contain bleach, and a second compartment 32*b* may contain an enzyme. One compartment 32 comprising the outwardly facing surface 22 may comprise granular materials.

A single compartment 32 may contain a homogenous mixture of materials. Alternatively, a single compartment 32 may contain plural strata 30 of materials. A compartment 32 may comprise liquids, granules, particulates, and combinations thereof.

FIG. 4 further shows a nonflushable grip 16. This grip 16 may be made of indissoluble, non-dispersible materials such as plastic, including without limitation polypropylene or polyethylene. Alternatively, such a grip 16 may be made of renewable materials such as bamboo or other wood.

The non-flushable grip 16 may be adhered to the balance of the unit dose 10 with water soluble adhesive and/or attached thereto through a common shell 12. In such a configuration, the non-flushable grip 16 may be juxtaposed with granular material and bolts of the granular material and grip 16 secured together with the film comprising the shell 12. The grip 16 may be generally round, or may have a shape congruent with that of the core 14 material of the unit dose 10.

A second compartment 32*b* may comprise a liquid. If a grip 16 is present, generally the grip 16 may comprise one or more granular materials, rather than a liquid. For reasons of deformability, a unit dose 10 containing an optional liquid in the core 14, or one or more compartments 32 thereof, may contain an air bubble having a volume of 10 to 50%, of the volume of the core 14.

If desired, one or more strata 30 or compartments 32 may include inorganic materials suitable for scrubbing the target surface. The inorganic materials may include small particulates which may not be water soluble or even water dispersible. But the particulates may be small enough to be flushable and this usable with the unit dose 10 of the present invention.

The process for making a water-soluble single compartment 32 unit dose 10 according to the present invention is similar to the process for making a pouch as described in commonly assigned EP1504994, WO02/4035. The process for making a plural compartment 32 water-soluble pouch is described in commonly assigned patent application 09161692.0 filed June 2009.

The unit dose 10 of the present invention may be used for cleaning below the waterline of the toilet bowl, and/or above the waterline, including the toilet bowl rim. The unit dose 10 may be used without a handle, i.e. simply dropped into the toilet bowl. The dispersion/dissolution may result in cleaning without scrubbing or the use of a handle.

The unit dose 10 according to the present invention may be packaged for individual sale and use. Alternatively, a plurality of unit doses 10 may be packaged together for sale in a single purchase. The package of plural unit doses 10 may contain mutually identical unit doses 10 or may contain unit doses 10 which vary by size, grip 16 style, grip 16 presence, and or grip 16 chemistry.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A unit dose for cleaning a toilet, said unit dose comprising:

a water dispersible shell, and a core encased by and interior to said shell, said core comprising a plurality of granular materials disposed in an equivalent plurality of strata and being free of non-woven material and cellulose material, said unit dose having a generally planar configuration and further comprising a grip extending outwardly from said generally planar configuration, wherein said unit dose is attachable to a handle at said grip, said grip comprising at least one granular material.

2. A unit dose according to claim 1 wherein said core further comprises a liquid material.

3. A unit dose for cleaning a toilet and optionally being attachable to a handle, said unit dose comprising:

a water dispersible shell, said shell being divided into plural compartments; and a core encased by said shell, said core being free of sheet material and comprising a plurality of different materials, wherein one material of said plurality is disposed in each of said plurality of compartments, said core comprising at least three compartments, a first outwardly facing compartment juxtaposed with said shell and comprising surfactant, a second compartment comprising organic acid and an effervescent, said second compartment being interposed between said first compartment and a third compartment, said third compartment being substantially disposed within a grip and predominantly comprising an effervescent.

4. A unit dose according to claim 3 comprising a first compartment and a second compartment adjacent thereto, said second compartment further comprising a surfactant.

5. A unit dose according to claim 4 wherein said core further comprises an additive selected from the group consisting of: perfume, disinfectants, bleaches, detergents, enzymes, partciulates and combinations thereof.

6. A unit dose for cleaning a toilet and being attachable to a handle, said unit dose comprising:

a water soluble shell, and a core encased by said shell, said core comprising at least one granular material and being free of sheet material, said unit dose having an outwardly facing surface and a grip oppositely extending therefrom, said outwardly facing surface comprising a microtexture of asperities for scrubbing a target surface while said asperities are submerged in water.

7. A unit dose according to claim 6 wherein said outwardly facing surface further comprises macro-irregularities creating a first surface texture, and asperities thereon creating a microtexture.

8. A unit dose according to claim 7 wherein said core comprises plural compartments of granular materials, said granular materials having different particle sizes and creating said asperities on said outwardly facing surface.

9. A unit dose according to claim 8 wherein said shell comprises PVOH.

10. A unit dose according to claim 9 wherein said shell further comprises plural layers of PVOH disposed on and bounding said grip.

11. A unit dose according to claim 10 wherein said shell further comprises a heat seal circumscribing said core, said heat seal defining a flange extending radially outwardly from said core.

12. A unit dose according to claim 7 wherein said macro-texture comprises a plurality of outwardly extending protuberances.

13. A unit dose according to claim 12 wherein said outwardly extending protuberances are arranged in a grid, said grid having protuberances of mutually different geometries.

14. A unit dose according to claim 7 further comprising particulates disposed in said core, said particulates being selected from the group consisting essentially of: diatomaceous earth, coconut shell fibers, walnut shells, crushed sea shells, calcium carbonate, sodium dodecyl benzene sulfonate, zeolites and combinations thereof.

15. A unit dose for cleaning a wetted target surface and optionally being attachable to a handle, said unit dose comprising:

a water soluble shell having an outer face and an inner face opposed thereto, and a core encased by said shell, said core being free of sheet material, and having an outwardly facing surface defined by and interior to said shell, said core comprising farinaceous granular material disposed adjacent said inner face of said shell wherein said core comprises plural compartments, said compartments being separated by shell material at least one said compartment comprising a non-flushable grip and at least one said compartment comprising a liquid material suitable for cleaning a wetted surface.

* * * * *